US007070449B2

(12) United States Patent
Miyazaki

(10) Patent No.: US 7,070,449 B2
(45) Date of Patent: Jul. 4, 2006

(54) CONNECTOR AND MANUFACTURING METHOD OF THE SAME

(75) Inventor: Sho Miyazaki, Mie (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/873,159

(22) Filed: Jun. 23, 2004

(65) Prior Publication Data

US 2004/0266261 A1 Dec. 30, 2004

(30) Foreign Application Priority Data

Jun. 27, 2003 (JP) ..... 2003-185227

(51) Int. Cl.
*H01R 13/40* (2006.01)

(52) U.S. Cl. ..... 439/587; 439/272; 439/606; 439/736

(58) Field of Classification Search ..... 439/587–588, 439/589, 736, 606, 271, 272, 275
See application file for complete search history.

(56) References Cited

U.S. PATENT DOCUMENTS

| | | | | |
|---|---|---|---|---|
| 3,757,274 | A * | 9/1973 | Hazelhurst | 439/281 |
| 5,057,030 | A * | 10/1991 | Hutson et al. | 439/247 |
| 5,597,324 | A * | 1/1997 | Katsunori | 439/587 |
| 5,931,699 | A * | 8/1999 | Saito | 439/587 |
| 5,980,329 | A * | 11/1999 | Klein et al. | 439/736 |
| 6,152,781 | A * | 11/2000 | Huang | 439/686 |
| 6,716,071 | B1 * | 4/2004 | Miyazaki | 439/859 |

FOREIGN PATENT DOCUMENTS

JP A 60-124374 7/1985

* cited by examiner

*Primary Examiner*—Briggitte Hammond
*Assistant Examiner*—X. Chung-Trans
(74) *Attorney, Agent, or Firm*—Oliff & Berridge, PLC

(57) ABSTRACT

A connector of the invention includes a housing including a terminal fitting, which is made by resin molding; and a ring-like seal member made of rubber, which bonded by molding around a circumference of the terminal fitting so that sealing is steadily performed between the terminal fitting and the housing. It is not necessary to adjust an amount of sealing material applied to the terminal fitting in case that the sealing material is applied to the terminal fitting.

5 Claims, 6 Drawing Sheets

CONNECTOR AND MANUFACTURING METHOD OF THE SAME

BACKGROUND OF THE INVENTION

1. Field of the Invention

The present invention relates to a connector that is buried into a housing having a terminal fitting molded of resin.

2. Description of the Related Art

There is a connector of this kind in which a housing is molded of resin in such a manner that a terminal fitting is connected to a wire terminal, and a connecting portion between the terminal fitting and the wire is buried therein. This connector is employed in the environments where water-resistance is required. However, the housing simply molded of resin may contain some gaps in a contact portion between the terminal fitting and the housing, or a contact portion between the wire covering and the housing, due to low adhesion of materials, whereby it is apprehended that water or oil may enter the housing through the gap.

Thus, conventionally, there was a method in which a sealant is thinly coated on the outer circumferential face of the terminal fitting or the wire covering, and then the housing is molded, thereby securing a waterproofing performance with the sealant. The above constitution in which the terminal fitting molded of resin is waterproofed with the sealant was disclosed in JP-A-60-124374.

However, with the above waterproofing method for coating the sealant, it is difficult to manage the amount of coating the sealant, and it is feared that the sealing performance is decreased due to uneven coating.

SUMMARY OF THE INVENTION

The present invention has been achieved in the light of the above-mentioned problems, and it is an object of the invention to provide a connector that is buried into a housing having a terminal fitting molded of resin, whereby the sealing performance is stabilized.

According to one aspect of the invention, a connector including: a housing including a terminal fitting, which is made by resin molding; and a ring-like seal member made of rubber, which bonded by resin molding around a circumference of the terminal fitting to seal between the terminal fitting and the housing.

According to another aspect of the invention, the terminal fitting has a locating portion of locating the seal member by engaging the seal member in the locating portion.

According to yet another aspect of the invention, a method for manufacturing a connector, including: preparing a terminal fitting; bonding a ring-like seal member made of rubber around a circumference of the terminal fitting by resin molding; burring the terminal fitting into a housing; and sealing between the terminal fitting and the housing by the seal member.

According to yet another aspect of the invention, the method of manufacturing a connector further including: locating the seal member by engaging the seal member in a locating portion formed in the terminal fitting.

Since the seal member made of rubber is bonded by baking on the outer circumferential face of the terminal fitting as the seal means, it is possible to securely seal a gap between the terminal fitting and the housing because of a resiliency of the seal member without managing the coating amount of sealant which is required when the sealant is coated.

The seal member is securely bonded at a predetermined position because of the locating portion provided in the terminal fitting, and the seal performance with the seal member is securely enhanced.

BRIEF DESCRIPTION OF THE DRAWINGS

These and other objects and advantages of this invention will become more fully apparent from the following detailed description taken with the accompanying drawings in which.

DESCRIPTION OF THE PREFERRED EMBODIMENTS

Embodiment 1

Figure 1:
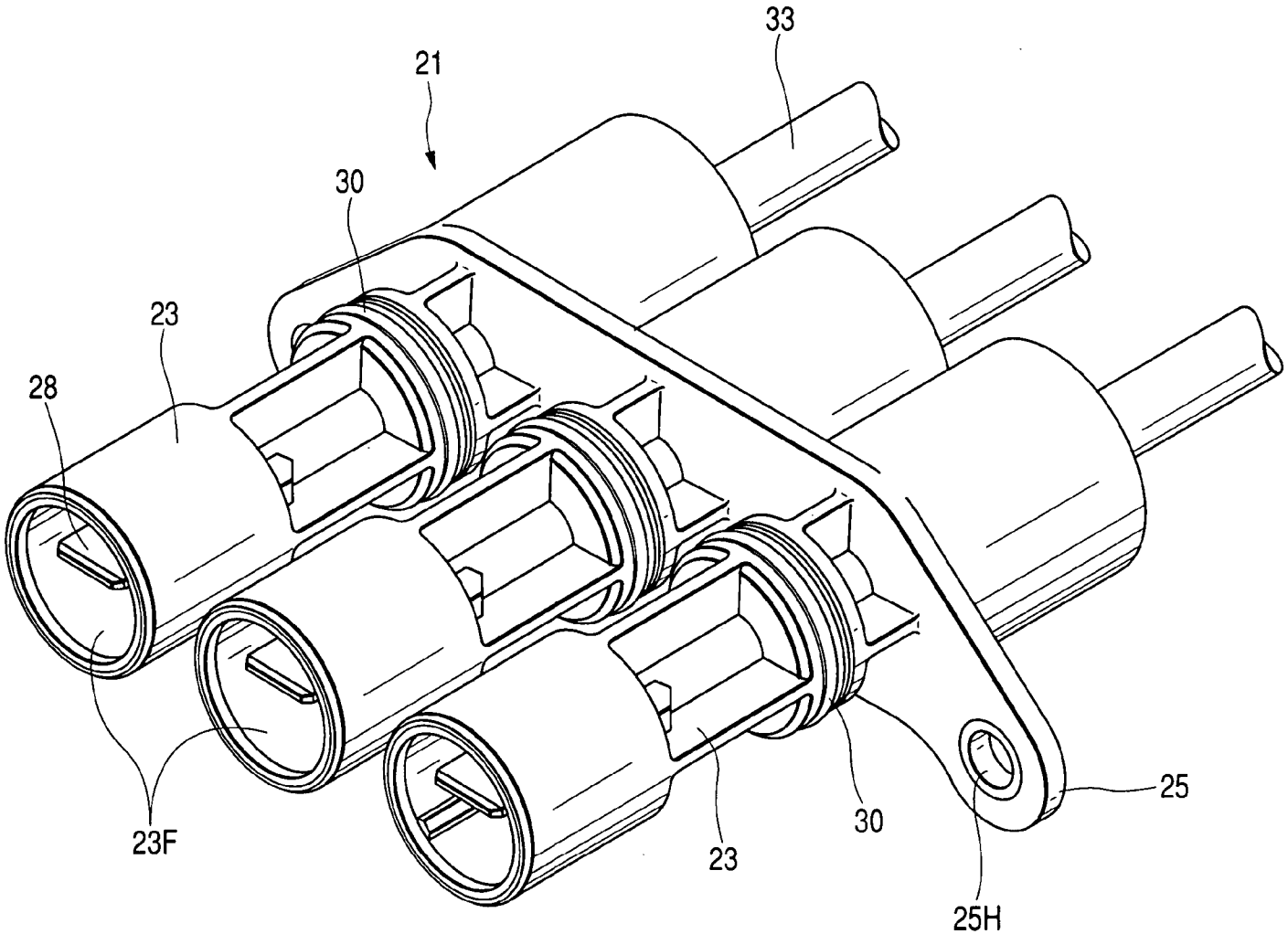
FIG. 1 is a perspective view of an apparatus side connector according to an embodiment 1.
Figure 2:
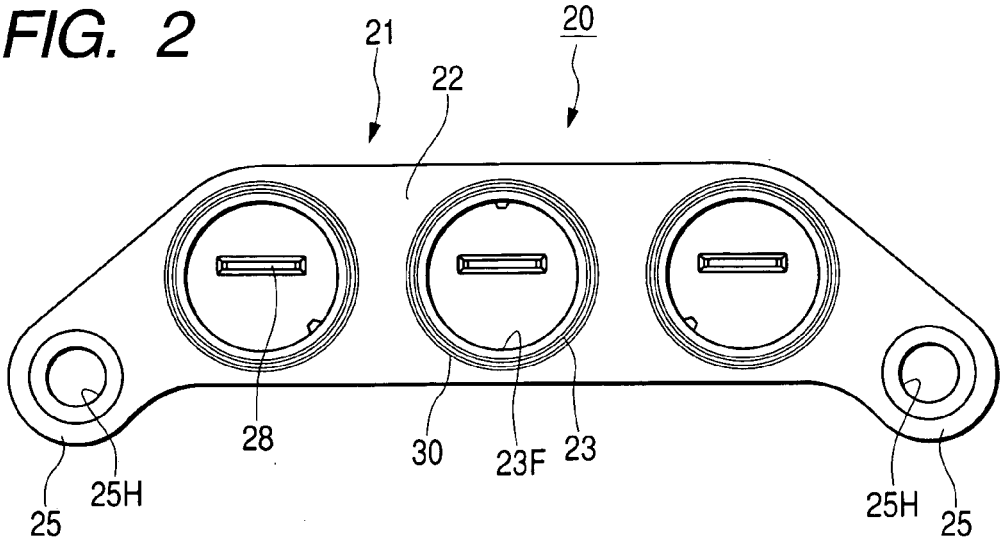
FIG. 2 is a front view of the apparatus side connector.
Figure 3:
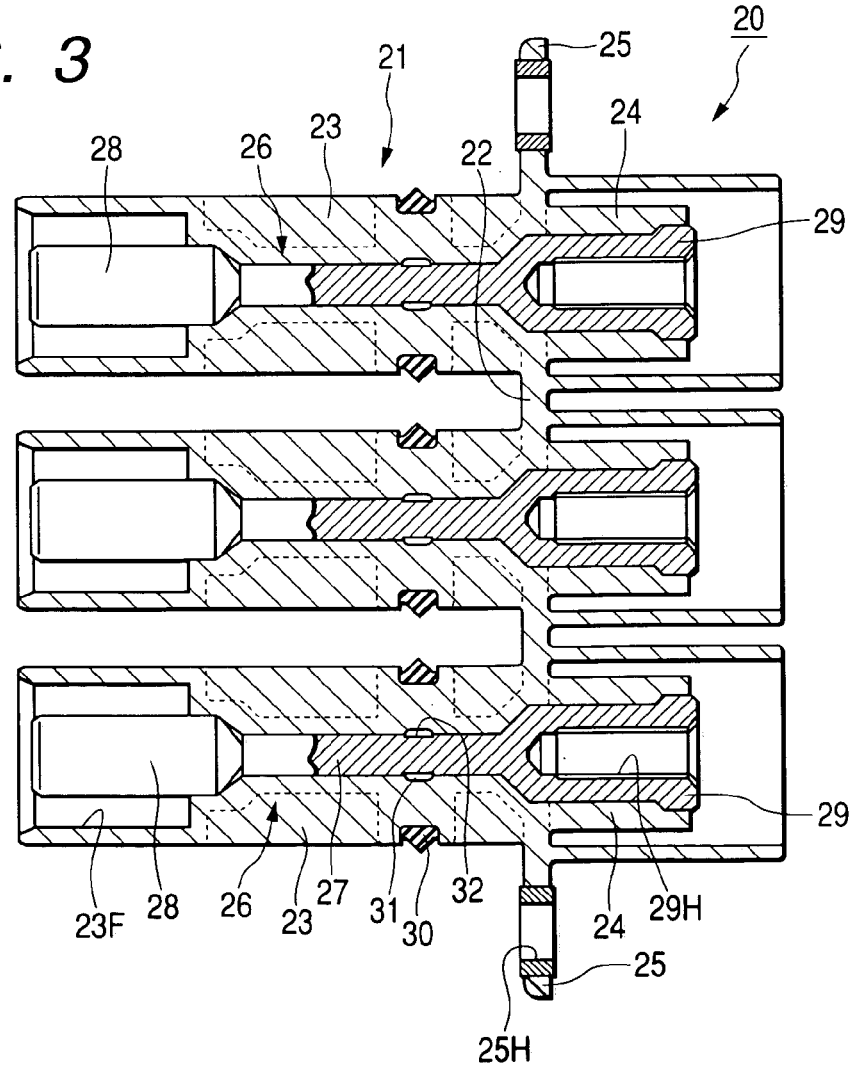
FIG. 3 is a horizontal cross-sectional view of the apparatus side connector.
Figure 4:
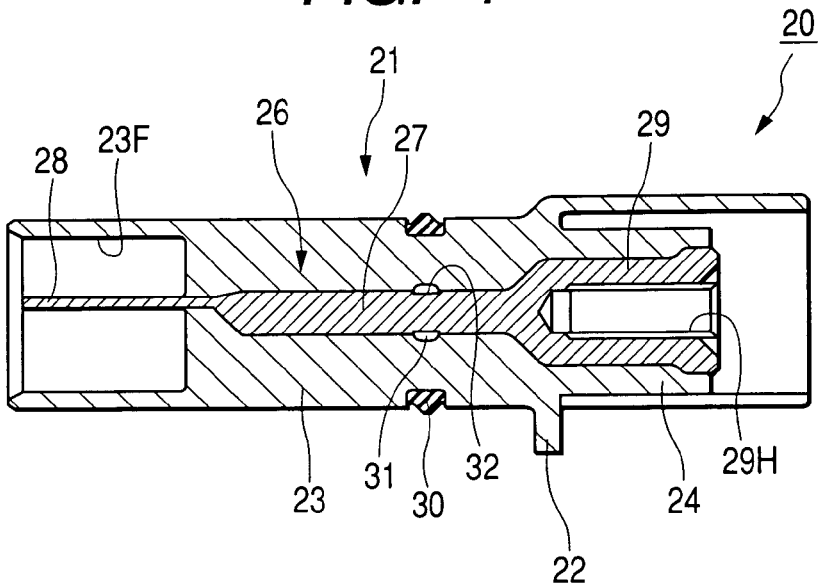
FIG. 4 is a longitudinal cross-sectional view of the apparatus side connector.
Figure 5:
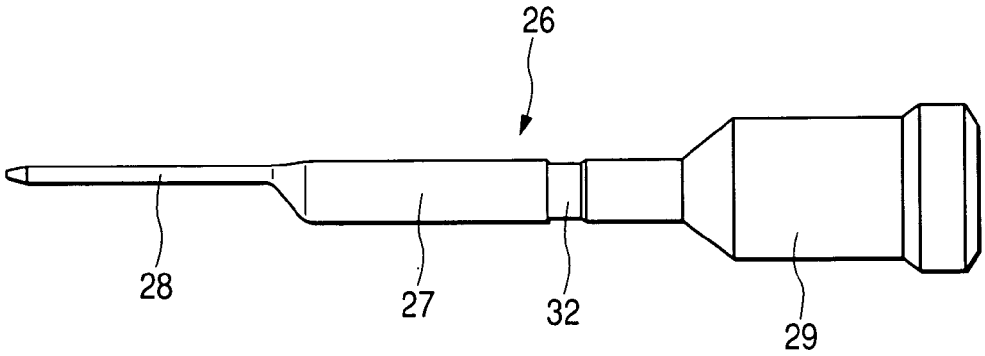
FIG. 5 is a side view of an apparatus side terminal fitting before bonding a seal member.
Figure 6:
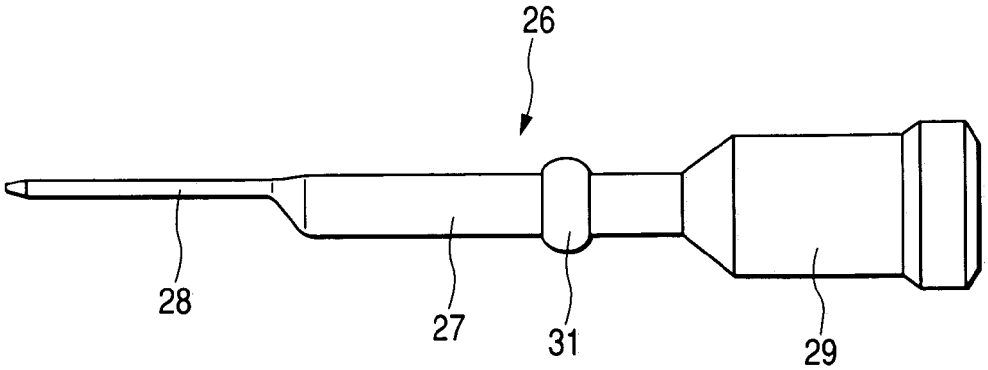
FIG. 6 is a side view of the apparatus side terminal fitting with the seal member bonded.
Figure 7:
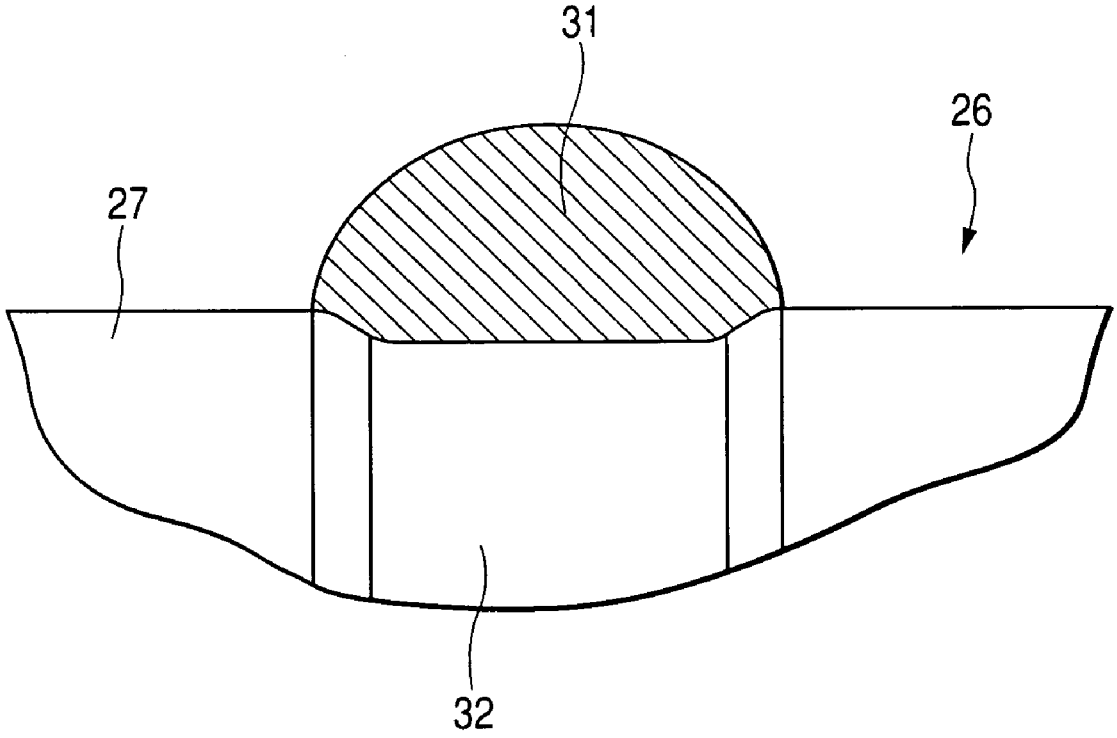
FIG. 7 is an enlarged side view, partly cut away, showing a bonding portion between the apparatus side terminal fitting and the seal member.
Figure 8:
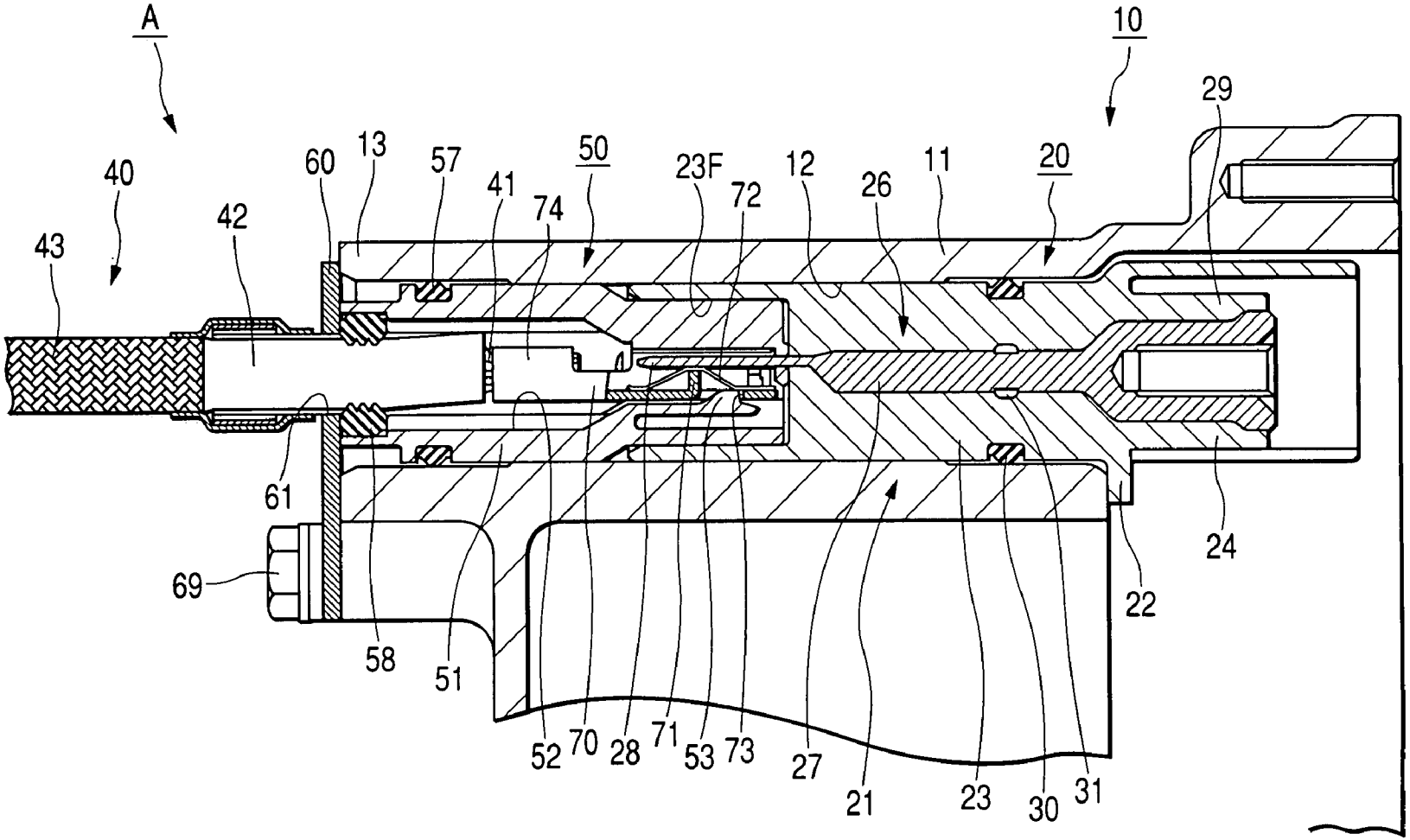
FIG. 8 is a longitudinal cross-sectional view of the apparatus side connector and the wire side connector that are connected.
Figure 9:
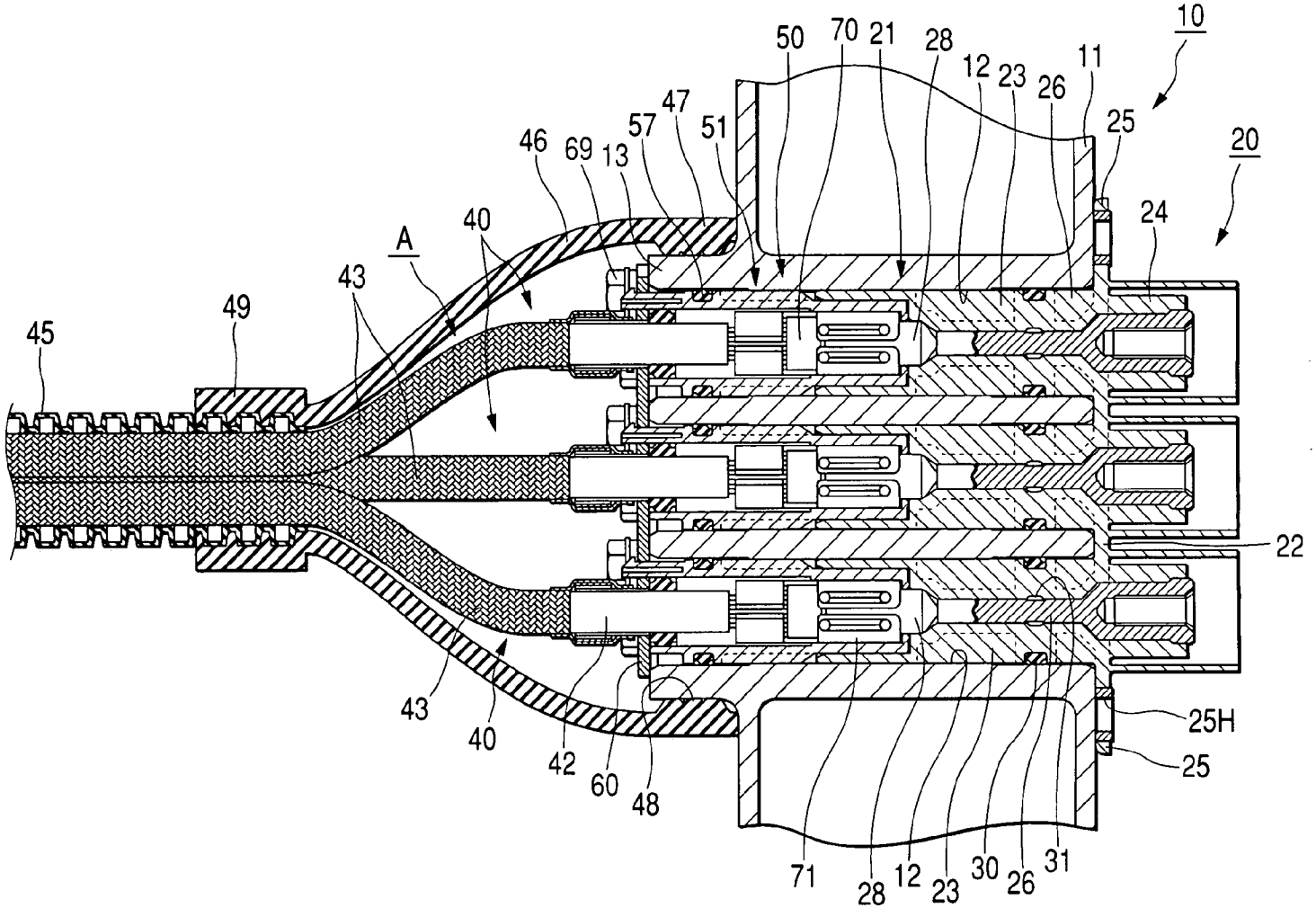
FIG. 9 is a horizontal cross-sectional view of the apparatus side connector and the wire side connector that are connected.

Referring to FIGS. 1 to 9, an embodiment 1 of the present invention will be described below.

An apparatus side connector 20 (a connector constituting the invention) of this embodiment is provided on an apparatus 10 (e.g., an inverter device for electric automobile) and connected to a wire side connector 50 making up a conductive path A having a shielding function.

In the apparatus 10, an apparatus main body (not shown) is contained within a conductive shield case 11, and the apparatus side connector 20 connected to the apparatus main body is contained within the same shield case 11. At the upper end part on a side wall of the shield case 11, three circular mounting holes 12, left and right, to penetrate longitudinally are formed at a fixed pitch. On an outside face of the shield case 11, a bulge portion 13 in the form where the open areas of the three mounting holes 12 and their peripheral areas are extended outside is formed. The outer circumference of the bulge portion 13 has a relatively simple shape (e.g. ,oblong, rectangle with rounded angles, trapezoid with rounded angles) by continuing a plane and a curved face smoothly. On a bulged end face of the bulge portion 13 (left end face in FIGS. 1 and 2), three mounting holes 12 are opened, and three internal thread holes (not shown) located obliquely downwards to each mounting hole 12 are bored.

The apparatus side connector 20 is buried in the apparatus side housing 21 having three apparatus side terminals 26 molded of resin in the form of penetrating longitudinally. The apparatus side housing 21 comprises a connecting portion 22 of a single component, and having an almost oblong shape slender in the cross direction, and three almost columnar fitting portions 23 disposed side by side extending forwards (to the left in FIG. 1) from the connecting portion 22. The connecting portion 22 is formed with three barrel portions 24, left and right, extending backwards from the rear end face and coaxially with the fitting portion 23, and a pair of plate-like mounting portions 25, left and right, extending sideways from both left and right end portions. At a front end portion of each fitting portion 23, a circular fitting concave portion 23F opening to the front face is formed. Also, a seal ring 30 is fitted around the circumference of a circular portion of each fitting portion 23.

Inside the apparatus side housing 21, three apparatus side terminals 26 corresponding to the fitting portions 23 and the barrel portions 24 are molded of resin and buried. The apparatus side terminal 26 is composed of a terminal main body 27, a tab 28, and an apparatus connecting portion 29. The apparatus main body 27 is circular in cross section, slender longitudinally, and buried in the fitting portion 23. The tab 28 projects forwards from the front end of the terminal main body 27 like a plate wider than the terminal main body 27, facing within the fitting concave portion 23F. An apparatus connecting portion 29 extends backwards with a larger diameter than the terminal main body 27 and concentrically with the terminal main body 27 from the back end of the terminal main body 27, and is buried in the barrel portion 24. A conductive member 33 such as a cable extending from the apparatus main body is screwed into an internal thread hole 29H of the apparatus connecting portion 29.

A contact portion between the apparatus side terminal 26 and the apparatus side housing 21 is sealed by a cylindrical seal member 31 provided around the circumference of the apparatus side terminal 26. The seal member 31 is cylindrical as a whole, and closely contacted with the outer circumference of the circular terminal main body 27. A shallow locating recess 32 (locating portion constituting this invention) continuously provided circumferentially is formed on the circumference of the terminal main body 27. This locating recess 32 is like a circle having a smaller diameter than the terminal main body 27, and concentric with the terminal main body 27. The seal member 31 is fitted on the locating recess 32. The seal member 31 is positioned longitudinally (axially) in the terminal main body 27 by engaging or contacting both longitudinal ends with both longitudinal step portions of the locating recess 32.

An inner circumferential face of the seal member 31 contact with the outer circumferential face of the locating recess 32 is a circular face with a constant radial size in the longitudinal direction. On the other hand, an outer circumferential face of the seal member 31 is a semicylindrical curved face having the largest diameter centrally in the longitudinal direction and a gradually smaller diameter toward both longitudinal ends. The locating recess 32 is formed at almost same position as the seal ring 30 provided around the fitting portion 23 in the longitudinal direction.

Such seal member 31 is bonded with the terminal main body 27 by baking. An injection molding and a press working may be applied to the terminal main body 27. An injection molding method involves setting an area of the terminal main body 27 where the locating recess 32 is formed in a mold (not shown), injecting a thermally molten rubber within a cavity of the mold, solidifying it to mold the seal member 31, and at the same time bond it to the terminal main body 27. A press working method involves pressing a mold (not shown) onto the circumference face of the seal member 31 in a state where the seal member 31 molded cylindrically is fitted around the locating recess 32, and at the same time heating to bond the seal member 31 to the terminal main body 27. The seal member may be made of Polyphenylene Sulfide(PPS).

The apparatus side terminal 26 having the seal member 31 bonded (integrated) by baking in this manner is set within a mold (not shown), and molten resin is injected into the cavity of the mold. When the injected resin is cured, the apparatus side housing 21 is molded of resin in the form of having the apparatus side terminal 26 buried, so that the apparatus side housing 21 and the apparatus side terminal 26 are integrated. From the above, a manufacturing process for the apparatus side connector 20 is completed.

Such apparatus side connector 20 is assembled into the shield case, using a bolt (not shown) penetrating through a bolt hole 25H of the plate-like mounting portion 25, in a state where each fitting portion 23 is tightly fit into the mounting hole 12 from the inside of the shield case 11, and the connecting portion 22 and the plate-like mounting portion 25 are contacted with the inner face of the shield case 11. In the assembled state, the fitting recess 23F and its internal tab 28 are on standby to prepare for connection between the wire side connector 50 and a wire side terminal 70 within each mounting hole 12.

A shield wire 40 constituting a conductive path A is constituted by providing a core 42 made of insulating resin material around the circumference of a conductor 41, and covering a barrel-like shield layer 43 having a metal wire braided like a mesh around the circumference of the core 42. The shield wire 40 has the shield layer 43 exposed over its entire length. At a terminal part of the shield wire 40, an end portion of the shield layer 43 is cut short, and an end portion of the core 42 is exposed. Furthermore, a terminal part of the core 42 is removed to expose the end portion of the conductor 41. The shield wire 40 is provided by bundling three wires together.

Most of the shield wire 40 except for the end portion is inserted into a corrugate tube 45. Moreover, the end portion of the shield wire 40 is surrounded by a rubber boot 46. The corrugate tube 45 is made of synthetic resin, like cylindrical bellows as a whole, and is deformable flexibly along a wiring path of the shield wire 40 in a state where the shield wire 40 is internally received. The rubber boot 46 has a shape of a barrel as a whole, and of being wider toward the front. A front end portion of the rubber boot 46 is a larger diameter fitting portion 47 that is fitted around the bulge portion 13 of the shield case 11, and a lip portion 48 extending circumferentially is formed on its inner circumference. On the other hand, a rear end portion of the rubber boot 46 is a circular smaller diameter fitting portion 49 that is fitted around the end portion of the corrugate tube 45, and an irregular portion matched with a circumferential shape of the corrugate tube 45 is formed on its inner circumference. Such corrugate tube 45 and rubber boot 46 surround three shield wires 40 collectively.

The wire side connector 50 comprises a wire side housing 51, a bracket 60, and a wire side terminal 70. The wire side housing 51 is made of synthetic resin, and roughly cylindrical as a whole. Inside the wire side housing 51, a circular cavity 52 penetrating through both longitudinal end faces. On a lower face at the front end part of the cavity 52, a lance 53 for preventing slippage of the wire side terminal 70 is formed. A seal member 57 is fitted around the circumference of the wire side housing 51. At a rear end part of the wire side housing 51, a bracket 60 made of conductive material such as metal and having the shape of a roughly oval plate as a whole is attached. The bracket 60 is connected to the shield layer 43 of the shield wire 40 to be conductible.

The apparatus side terminal 70 is slender as a whole in the longitudinal direction, and formed with an apparatus connecting portion 71 like a roughly angular sleeve connected to the tab 28 of the apparatus side terminal 26 in its roughly former half part. An elastic contact piece 72 is provided inside the apparatus connecting portion 71, and a lance bore 73 is formed on a lower face of the apparatus connecting portion 71. On the other hand, a roughly latter half part of the wire side terminal 70 is a wire contricted part 74. A front end part of the conductor 41 of the shield wire 40 exposed out of the core 42 is connected by contriction to the wire contricted part 74 to be conductible.

The wire side housing 51 of the wire side connector 50 is fitted into the mounting hole 12 of the shield case 11. Inside the mounting hole 12, the apparatus side housing 21 is on standby. If the wire side housing 51 is fitted sufficiently to the depth that the bracket 60 is contacted with the outside face of the shield case 11, its front end part is fitted into the fitting recess 23F of the apparatus side housing 21, and the tab 28 enters into the apparatus connecting portion 71 of the wire side terminal 70, to resiliently contact with the elastic contact piece 72, so that both the terminals 26 and 70 are connected conductibly.

In a state where the wire side housing 51 is fitted into the mounting hole 12, a bolt 69 penetrated through a bolt hole (not shown) of the bracket 60 is screwed into an internal thread bore (not shown) of the shield case 11, and fastened, so that the apparatus side housing 51 is secured to the shield case 11. In this state, the bracket 60 is connected conductibly to an outer wall face of the shield case 11, so that the shield layer 43 of the shield wire 40 is connected conductibly to the shield case 11.

Moreover, the larger diameter fitting portion 47 at the front end of the rubber boot 46 is fitted around the bulge portion 13 of the shield case 11, and the lip portion 48 is resiliently contacted with its outer circumference. Thereby, a connection portion between the bracket 60 and the shield layer 43 is waterproofed.

Within the mounting hole 13, the seal member 57 provides a seal between the inner circumference of the mounting hole 12 and the outer circumference of the wire side housing 51. Also, a gap between the inner circumference of the mounting hole 12 and the apparatus side housing 21 is sealed with the seal ring 30 fitted around the fitting portion 23. Moreover, the seal member 31 fitted around the circumference of the fitting portion 27 provides a seal between the outer circumference of the apparatus side terminal 26 and the inner circumference of the apparatus side housing 21. With these seals, an oil within the shield case 11 is securely prevented from leaking through the mounting hole 12 out of the shield case 11. Also, water outside the shield case 11 is securely prevented from entering the shield case 11 through the mounting hole 12.

As described above, in this embodiment, the rubber seal member 31 as means for sealing between the apparatus side housing 21 and the apparatus side terminal 26 is bonded by baking on the outer circumferential face of the apparatus side terminal 26. Therefore, the seal member 31 can provide a secure seal between the apparatus side terminal 26 and the apparatus side housing 21 without coating the sealant as the seal means by controlling the coating amount. That is, the seal member 31 is bonded by baking for secure seal between the outer circumferential face of the apparatus side terminal 26 and the inner circumferential face of the seal member 31. The seal member 31 is closely contacted with the inner circumferential face of the cavity side housing 21 due to its resiliency to provide a secure seal between the outer circumferential face of the seal member 31 and the inner circumferential face of the apparatus side housing 21.

Also, since the apparatus side terminal 26 is provided with the locating recess 32, the seal member 31 is securely bonded at a predetermined position because of this locating recess 32, whereby the seal performance of the seal member 31 is securely enhanced.

This invention is not limited to the above embodiment with reference to the drawings. For example, the following embodiments may also fall within the technical scope of the invention, and various variations may be made thereto without departing the spirit or scope of the invention.

(1) Though in the above embodiment, the apparatus connector is involved, the invention is also applicable to connectors (e.g., connecting the wire harnesses) other than the apparatus connector.

(2) Though in the above embodiment, the apparatus side connector of the wire side connector and the apparatus side connector is involved, this invention is applicable to the wire side connector.

(3) Though in the above embodiment, the housing of the wire side connector and the housing of the apparatus side connector are fitted together, this invention is also applicable to a case where the terminal of the wire side connector is connected to the bare apparatus side terminal without employing the apparatus side housing.

(4) Though in the above embodiment, a plurality of apparatus side terminals are held in one apparatus side housing, one apparatus side terminal may be held in one apparatus side housing in this invention.

(5) Though in the above embodiment, the terminal fitting (apparatus side terminal) is of male type, this invention is also applicable to the terminal fitting of female type.

(6) Though in the above embodiment, the bonding portion of the seal member in the terminal fitting (apparatus side terminal) is circular in cross section, this invention is also applicable to a case where the bonding portion of the seal member in the terminal fitting is non-circular (e.g., oblong, ellipse, square with four corners beveled like arc, polygons other than quadrilateral).

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A connector comprising:

a housing including a terminal fitting, which is made by resin molding; and a ring-shaped seal member made of rubber, which is bonded by resin molding around a circumference of the terminal fitting to seal between the terminal fitting and the housing;

wherein the terminal fitting includes a locating portion that includes a recess portion and locates the seal member by engaging the seal member in the locating portion, and the housing contacts the terminal fitting at both sides of the recess portion.

2. A method for manufacturing a connector, comprising the steps of:

preparing a terminal fitting;

bonding a ring-shaped seal member made of rubber around a circumference of the terminal fitting by resin molding;

burying the terminal fitting into a housing, wherein burying the terminal fitting into the housing comprises injecting molten resin around the terminal fitting;

sealing between the terminal fitting and the housing by the seal member; and locating the seal member by engaging the seal member in a locating portion that includes a recess portion and is formed in the terminal fitting.

3. The method according to claim 2, wherein preparing the terminal fitting comprises preparing a terminal fitting including (i) a first end portion, (ii) a second end portion, (iii) an intermediate portion between the first end portion and the second end portion, the intermediate portion being narrower than the first end portion and the second end portion, and (iv) the locating portion, the locating portion being formed at the intermediate portion.

4. A connector comprising:

a housing including a terminal fitting, which is made by resin molding; and a ring-shaped seal member made of rubber, which is bonded by resin molding around a circumference of the terminal fitting to seal between the terminal fitting and the housing;

wherein the terminal fitting includes (i) a first end portion, (ii) a second end portion, (iii) an intermediate portion between the first end portion and the second end portion, the intermediate portion being narrower than the first end portion and the second end portion, and (iv) a locating portion formed at the intermediate portion, the locating portion locating the seal member by engaging the seal member in the locating portion, and the housing contacts the terminal fitting at both sides of the recess portion.

5. The connector according to claim 4, wherein the housing contacts the first end portion, the second end portion and the intermediate portion.

* * * * *